US005968390A

United States Patent [19]

Lister

[11] Patent Number: 5,968,390

[45] Date of Patent: Oct. 19, 1999

[54] SYSTEM FOR MELTING GLYCERINE SOAP

[76] Inventor: Stephen Lister, 2015 Maine Ave., Long Beach, Calif. 90806

[21] Appl. No.: 09/020,262

[22] Filed: Feb. 9, 1998

[51] Int. Cl.[6] ..... F27B 14/14; C11D 13/00

[52] U.S. Cl. ..... 219/421; 219/432; 219/433; 222/146.5

[58] Field of Search ..... 219/385, 386, 219/420–422, 424, 429, 432, 433; 222/146.2, 146.5; 425/144; 510/147

[56] References Cited

U.S. PATENT DOCUMENTS

| | | | |
|---|---|---|---|
| 1,462,224 | 7/1923 | Bausert | 219/421 |
| 1,713,249 | 5/1929 | Abbott et al. | 219/421 |
| 4,030,867 | 6/1977 | Everman | 425/144 |
| 4,474,683 | 10/1984 | Story et al. | 510/445 |
| 5,123,569 | 6/1992 | Lindner | 222/56 |
| 5,662,243 | 9/1997 | Bondeson et al. | 222/1 |

FOREIGN PATENT DOCUMENTS

| | | | |
|---|---|---|---|
| 218439 | 8/1957 | Australia | 219/421 |

*Primary Examiner*—Jospeh Pelham
*Attorney, Agent, or Firm*—Charles H. Thomas

[57] ABSTRACT

A method and apparatus are provided for melting glycerine soap base in a kettle having a top opening, upright side walls, and a funnel-shaped bottom with a drain at its center. The kettle is surrounded with a thermally insulated jacket having a floor spaced below the bottom of the kettle to define a hollow, thermally insulated, air filled heating cavity beneath the bottom of the kettle. The kettle is supported completely externally relative to the heating cavity to hold the kettle above the floor of the jacket. Preferably, the supporting structure includes a cart or carriage by means of which the apparatus may be moved. A plurality of infrared lamps, preferably operated at 110 volts and consuming no more than two hundred fifty watts of power each, are mounted atop the floor of the jacket and directed upwardly toward the bottom of the kettle. The kettle bottom is uniformly heated from within the heating cavity to melt blocks of glycerine soap base in the kettle and maintain a temperature in the kettle of between 130° F. and 140° F. Blocks of solidified glycerine soap base are introduced into the top opening of the kettle while melted glycerine soap base is withdrawn through the drain at the bottom of the kettle for the addition of additives thereto to produce cakes of glycerine soap.

20 Claims, 6 Drawing Sheets

SYSTEM FOR MELTING GLYCERINE SOAP

BACKGROUND OF THE INVENTION

1. Field of the Invention

The present invention relates to a method and apparatus for melting a glycerine soap base for use in casting cakes of glycerine soap.

2. Description of the Prior Art

The use of glycerine soap has gained significantly in popularity in recent years. Glycerine soap is softer than traditional soap that has been cast into cakes of soap for centuries. Moreover, oils of a variety of blends of different fragrances and colorants may be added to glycerine soap. Also, because glycerine soap is transparent or translucent, it lends itself to the addition of ribbons or pieces of solidified glycerine soap into liquified quantities of a soap base. These ribbons or solid pieces become encapsulated within a surrounding quantity of glycerine soap base, once that substance has cooled and solidified. The resulting cakes of soap are aesthetically pleasing for this reason.

Because glycerine soap is a salt of fat, it has a very substantial insulating effect. Therefore, glycerine soap bases absorb a great deal of heat in the melting process. Historically, cakes of glycerine soap were manufactured in five gallon soap pots. The reason the quantities of the soap kettles were so small was due to the large amount of heat required to melt a given quantity of glycerine soap.

Subsequently, different types of steam-jacketed devices were developed for melting glycerine soap. For example, one type of steam-jacketed glycerine soap kettle is manufactured by Groen, a Dover Industries Co. as the Model EE stainless steel, self-contained, steam-jacketed kettle. In this system, the jacket surrounding the kettle is heated by steam in order to melt the glycerine soap base. Another type of steam-jacketed kettle is manufactured by Legion Industries, Inc. under various model designations LEC/HEC.

Steam-jacketed glycerine soap kettles, while capable of melting volumes of glycerine soap significantly larger than was possible with the early five-gallon kettles, have significant disadvantages. The primary disadvantage is the very considerable power requirement for operation. Another disadvantage is that the volume of water required to generate the steam makes the units both bulky and extremely heavy. As a consequence, the cost of operation of steam-jacketed kettles makes their use prohibitively expensive to many glycerine soap manufacturers.

Steam-jacketed types of soap kettles require the application of four to five watts of power for each square inch of surface area of the kettle that is exposed to the steam heating source. Most glycerine soap bases melt at a temperature of between about 120° F. and about 130° F. The application of four to five watts of power per square inch of kettle surface area that is required for operation of conventional, steam-jacketed kettles leads to temperatures in the glycerine exceeding 150° F. This kind of heat scorches the glycerine, thus resulting in a product that is inconsistent in appearance and aesthetically displeasing to the user.

Conventional steam-jacketed glycerine soap melting systems are also subject to problems from corrosion due to minerals in the water employed to generate the steam required. These minerals form scales that clog the system and corrode the steam jacket. This leads to problems that can only be solved by an inordinate amount of preventative maintenance or the use of distilled water. With either approach, the cost of operating these devices is often prohibitively expensive.

SUMMARY OF THE INVENTION

The present invention provides both an apparatus and a method for melting a glycerine base in the production of glycerine soap that has very significant advantages over prior systems. According to the system of the present invention, a new and different heating system has been implemented for use in melting a glycerine soap base. Specifically, the system of the invention employs at least one electrical heating element located in an air cavity beneath the glycerine soap kettle in order to heat the glycerine soap base. While electrically operated heating elements of different types may be employed to generate heat in an air cavity beneath the glycerine soap kettle and within a surrounding thermal jacket, preferably an array of infrared electrical lamps are employed for this purpose. The electrical lamps are located within an enclosure directly beneath the bottom of the kettle. The lamps are employed in an array and are directed upwardly toward the bottom of the kettle.

By utilizing this unique heating approach in the melting of glycerine soap bases for use in casting cakes of glycerine soap, a system has been devised which allows far greater quantities of glycerine soap base to be melted with a substantially reduced power consumption, as compared to conventional steam-jacketed soap kettles. For example, the largest model LEC/HEC steam-jacketed kettle available has a kettle capacity of eighty gallons and requires at least a 280 volt alternative current power supply. At this voltage it draws 144.2 amps operated from a single phase power supply or 83.3 amps operated from a three-phase power supply. Alternatively, such systems can be operated from 240 volt or 480 volt power supplies to reduce the amperage required. Nevertheless, at least 43.3 amps of current at a minimum of 30 kilowatts of power is required for the operation of the largest unit, and this requires a 480 volt alternative current power supply.

Similarly, the Groen steam-jacketed kettles require 208, 240, or 480 volt, three-phase, 50 or 60 hertz power supplies for heating their largest kettle, which has a capacity of only one hundred gallons. This unit draws at least about 80 amps current and consumes at least about 32.4 kilowatts of power in operation.

By utilizing a method and apparatus for manufacturing glycerine soap according to the present invention, a soap kettle of at least about one hundred thirty gallons capacity can be used to melt a glycerine soap base using standard 110–120 volt, single phase, 60 hertz, alternating current. Moreover, only 15 amps of alternative electrical current are required to melt the glycerine soap base at a rate of one pound per minute. The system of the invention is therefore able to melt a glycerine soap base in quantities considerably larger than has heretofore been obtainable with steam-jacketed systems, using only standard electrical wiring present in virtually all buildings.

A further distinct advantage of the invention as compared to steam-jacketed kettle systems is that both the weight and expense of the equipment required to melt large quantities of a glycerine soap base is drastically reduced. The present invention requires no heavy jacket that must withstand steam pressure and accommodate the heavy volume of water required to generate steam. Conventional, steam-jacketed, glycerine soap melting kettle systems cost on the order of fifteen and twenty thousand dollars for the largest capacity system available. In contrast, an apparatus for melting glycerine soap in even larger quantities according to the present invention can be produced at a fraction of that cost.

A further advantage of the system of the present invention is that glycerine soap can be melted and maintained in a liquified state at a consistently lower temperature than is possible with steam-jacketed systems. Glycerine soap bases typically melt at a temperature of between about 120° F. and 130° F. Therefore, to melt the soap base and maintain it in a liquid state a temperature of 130° F. to 140° F. is optimal. However, conventional, steam-jacketed system are not able to closely control the temperature of the glycerine so that temperatures in excess of 150° F. in conventional steam-jacketed kettles are not uncommon. As a consequence, not only is excessive power utilized to raise the glycerine to a temperature above that required, but the excessive temperature leads to scorching that causes degradation of the glycerine soap. The system of the present invention avoids both the unnecessary expense and damage to the soap base by melting the soap and maintaining it in a molten state at a lower temperature than is possible with conventional systems.

In one broad aspect the present invention may be considered to be an apparatus for melting glycerine soap comprising: a kettle having a top opening, upright side walls, and a bottom with a drain at its center; a thermally insulated jacket disposed about the side walls and having a floor spaced beneath the bottom of the kettle to define a hollow, thermally insulated, air-filled heating cavity therebeneath; at least one electrically operated heating element disposed in the thermally insulated cavity atop the floor of the jacket and beneath the bottom of the kettle to uniformly heat the bottom of the kettle; and a structural support attached to the kettle and located entirely externally relative to the thermally insulated heating cavity to hold the kettle above the floor of the jacket.

Preferably, a plurality of electrically operated heating elements in the form of infrared heat lamps are employed and are disposed in an array atop the floor of the jacket. To heat a kettle having a capacity of one hundred fifty gallons, an array of only eight, two hundred fifty watt infrared heat lamps are required. The lamps are mounted atop the floor of the jacket directly beneath the bottom of the kettle and are directed upwardly toward the kettle bottom. Preferably, in the melting apparatus of the invention, the kettle has a capacity considerably greater than one hundred gallons, such as about one hundred thirty gallons. The heating element or elements required to melt the glycerine soap at a rate of one pound per minute in such a system are operated at no more than two thousand watts of power, and typically considerably less power.

The key features to the success of the glycerine soap melting system of the invention are the provision of an electrical heating source in an air cavity directly beneath the bottom of the soap kettle and the configuration of the cavity such that the transfer of heat upwardly from the electrical source to the bottom of the kettle is unobstructed. The kettle, like conventional glycerine soap melting kettles, is constructed of No. 304 stainless steel. This material is a relatively poor conductor of heat. Also, since glycerine soap is a salt of fat it exhibits a considerable insulating effect. Consequently, unless the bottom of the kettle is heated uniformly, hot spots will be created at which the glycerine soap will become scorched and degrade. By utilizing the array of infrared heat lamps in an enclosure in which there are no obstructions, uniformity of heating is maintained, and hot spots in the kettle are avoided.

One important way in which uniformity of heating of the kettle is maintained is achieved by locating the structural support for the kettle completely external to the air cavity in which the heat lamps are mounted. One way to achieve this is to suspend the kettle from above. However, a preferred apparatus employs a mobile cart having a plurality of vertical legs or posts directed upwardly from the cart and supporting the kettle externally of the jacket.

For example, a pair of mutually parallel, horizontally oriented support beams may be secured to opposite sides of the kettle above the jacket at the upper extremity of the kettle. The vertical legs of the structural support extend upwardly from the cart or carriage. The horizontal support beams at the top of the kettle rest atop the vertical legs. The mobile cart supports the vertical legs from beneath and the vertical legs in turn support the kettle externally of the sides thereof. Such a construction not only avoids any supporting superstructure in the area beneath the bottom of the kettle and above the heating elements, but also provides a system that is portable. This allows the apparatus to be towed out of a building into a parking lot, for example, where it may be cleaned.

In another broad aspect the invention may be considered to be a method of melting glycerine soap in a kettle having a top opening, upright side walls, and a bottom with a drain at its center in which the kettle is surrounded with a thermally insulated jacket having a floor spaced below the bottom of the kettle to define a hollow, thermally insulated, air filled heating cavity beneath the bottom of the kettle. According to the method of the invention, the kettle is supported externally relative to the heating cavity to hold the kettle above the floor of the jacket. The kettle bottom is uniformly heated from within the air filled cavity with at least one electrically operated heating element. Blocks of solidified glycerine soap base are introduced into the top opening of the kettle. The heating element or elements thereupon melt the glycerine soap base blocks and maintain the soap base at a temperature of no greater than 140° F. The melted glycerine soap base is withdrawn through the drain for the addition of additives thereto.

Preferably the method of the invention involves heating more than one hundred gallons of glycerine soap base in the kettle utilizing no greater than two thousand watts of power. Preferably, at least about one hundred thirty gallons of glycerine soap base are melted in the kettle in this way. Also, the method of the invention preferably comprises heating the bottom of the kettle with electrical power of no greater than two watts per square inch of surface area of the bottom of the kettle. More typically, the requisite temperature can be obtained and maintained utilizing only about one and one-tenth watts per square inch.

The invention may be described with greater clarity and particularity by reference to the accompanying drawings.

DESCRIPTION OF THE EMBODIMENT

Figure 1:
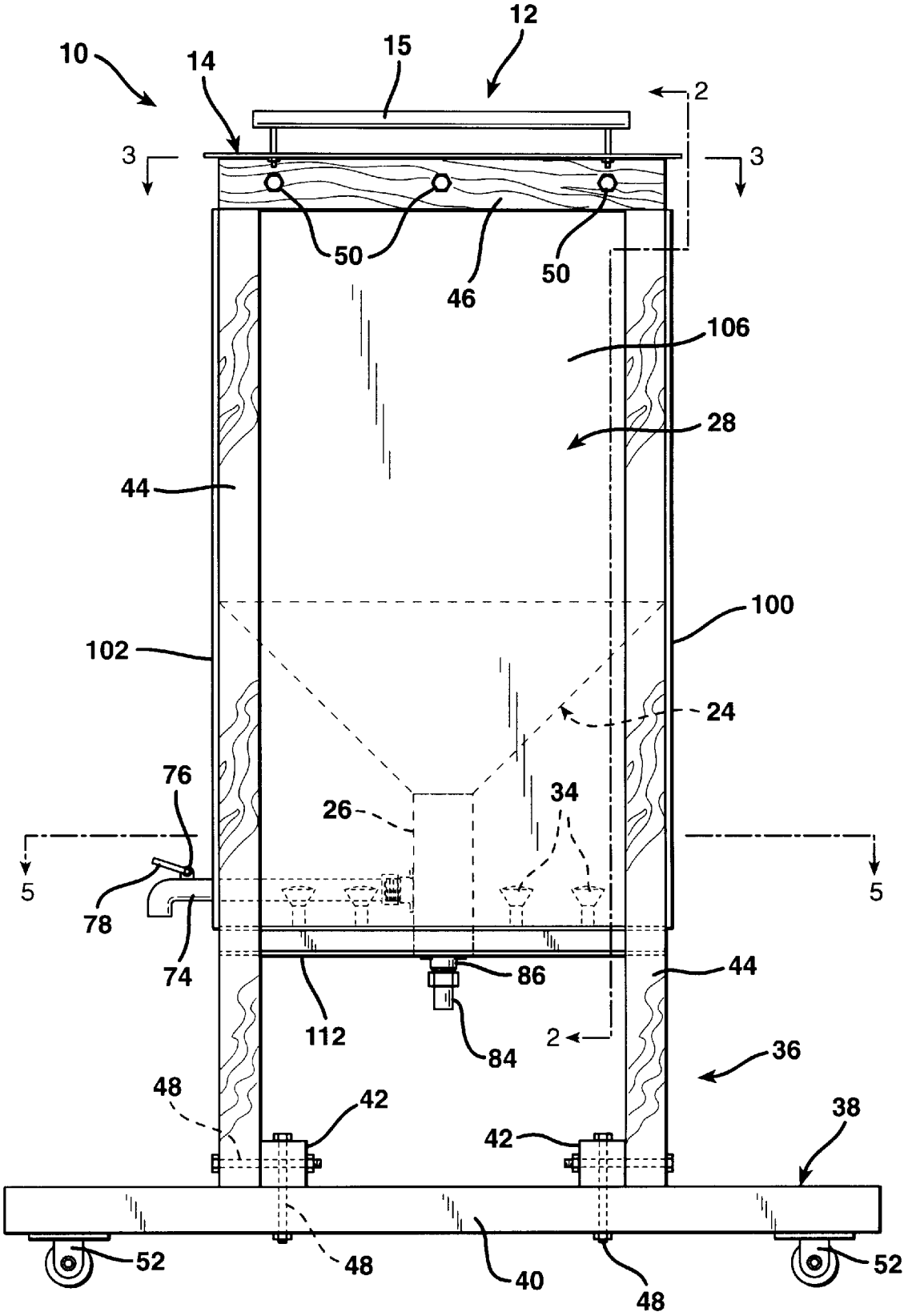
FIG. 1 is a side elevational view of an apparatus for melting glycerine soap base constructed according to the invention.

The drawing figures illustrate generally at 10 an apparatus for melting blocks of glycerine soap base. The apparatus 10 is comprised of a kettle 12 having a top opening covered by a lid 14, upright side walls 16, 18, 20, and 22, a bottom 24, and a drain 26 at the center of the bottom 24.

A thermally insulating jacket 28 is disposed about the kettle 12 so as to laterally surround the upright jacket side walls 16, 18, 20, and 22. The jacket 28 has a floor 30 spaced below the bottom 24 of the kettle so as to define an air cavity 32 beneath the bottom 24 of the kettle 12 and above the floor 30. Electrically operating heating elements in the form of an array of eight 250-watt infrared heat lamps 34 are mounted atop the floor 30 of the jacket 28 within the air cavity 32. The bulbs of the infrared heat lamps 34 uniformly heat the bottom 24 of the kettle 12.

The glycerine soap melting apparatus 10 also includes a supporting means 36 for holding the bottom 24 of the kettle 12 above the floor 30 of the jacket 28. The supporting means 36 is located completely external to the air cavity 32.

The supporting means 36 is comprised of a cart or carriage 38 formed by: two wooden beams 40, five feet in length supported by casters 52, each beam 40 having a nominal cross section of four inches by six inches; two, wooden, transverse, cross-connecting beams 42, both having a length of thirty-eight inches and each having a cross section of four inches by four inches; four, vertical, upright supporting posts 44, all six feet in length and each having a cross section of four inches by four inches; a pair of upper, horizontally oriented, wooden beams 46, each thirty-one and a half inches in length and each having a cross section of four inches by six inches.

As best illustrated in FIG. 1, the cross-connecting beams 42 are bolted to the longer beams 40 located therebeneath in perpendicular orientation relative thereto by means of four nine-inch carriage bolts 48. The lower ends of the vertical support posts 44 rest atop the beams 40 and are located immediately adjacent to and in contact with the cross-connecting beams 42. A second set of four nine-inch carriage bolts 48 is employed to bolt the lower ends of the vertical support posts 44 to the cross-connecting beams 42.

The ends of the upper support beams 46 rest atop the upper ends of the vertical support posts 44. One of the beams 46 is secured to the upper end of the side wall 20 of the kettle 12 by three one-half inch diameter bolts 50 that pass through the upper beam 46 and the side wall 20 three inches from the upper edge thereof. The bolts 50 are secured by nuts (not visible). The other upper beam 46 is similarly secured to the upper end of the side wall 22 of the kettle 12 by another set of three one-half inch diameter bolts 50.

The support means 36 of the invention also includes the four casters 52 attached to the undersides of the lower beams 40 near the longitudinal ends thereof. Together the casters 52, the lower beams 40, and the transverse cross-connecting beams 42 form a carriage or mobile cart 38. The cart 38 supports the vertical legs formed by the vertical support posts 44 from beneath.

Figure 2:
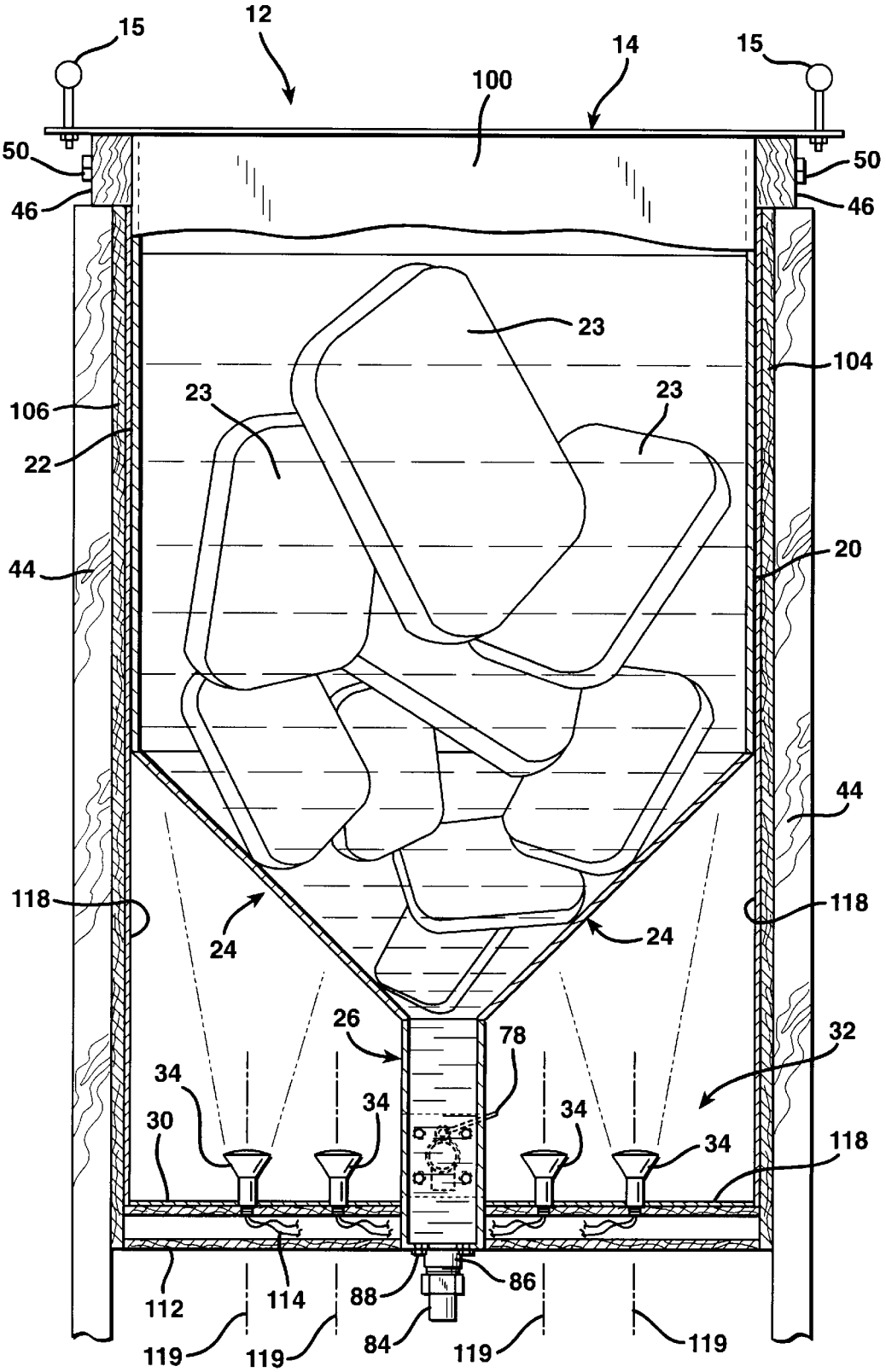
FIG. 2 is a side elevational view, partially broken away and partially in section, taken along the lines 2—2 of FIG. 1.
Figure 3:
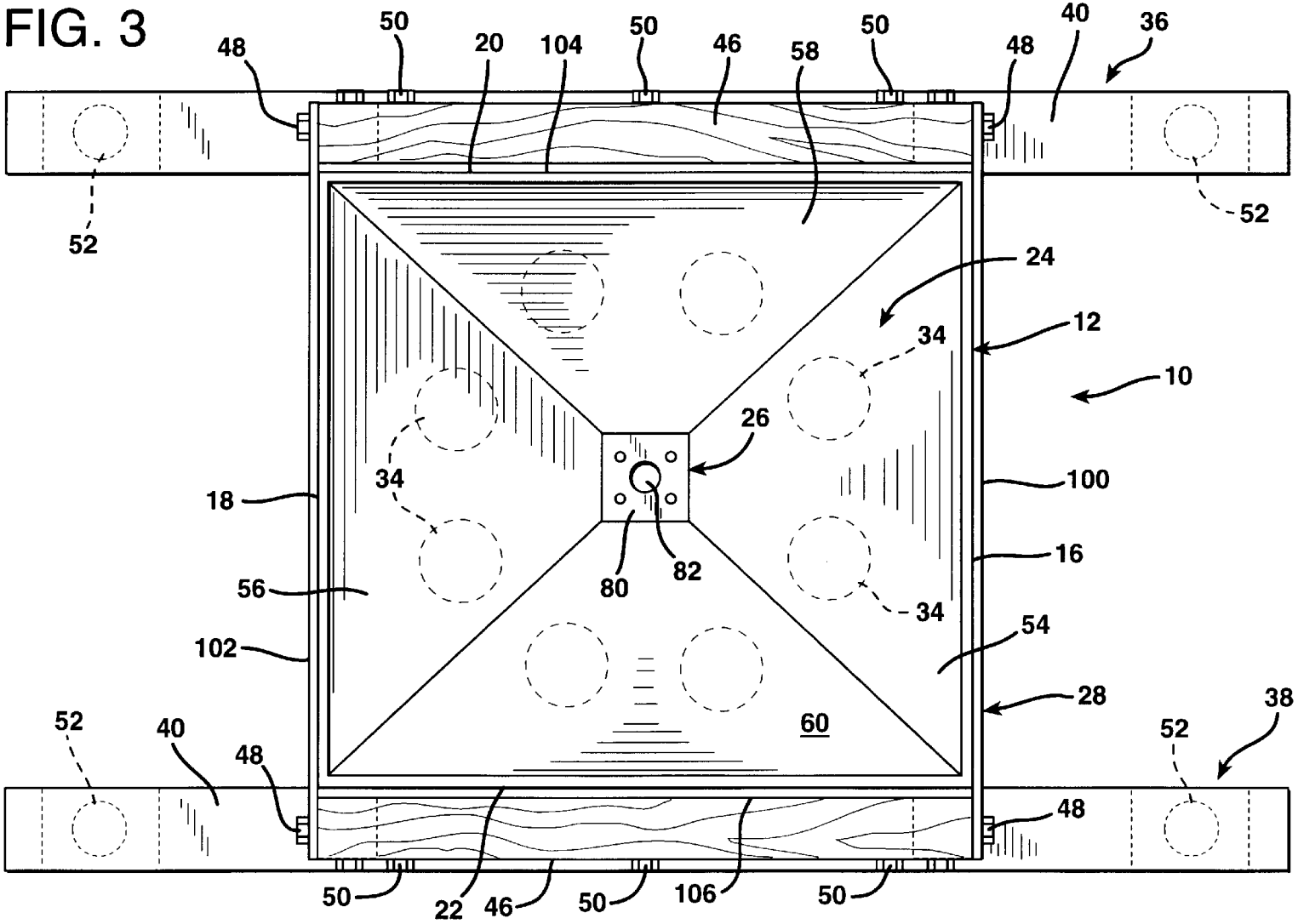
FIG. 3 is a top plan view taken along the lines 3—3 of FIG. 1.
Figure 4:
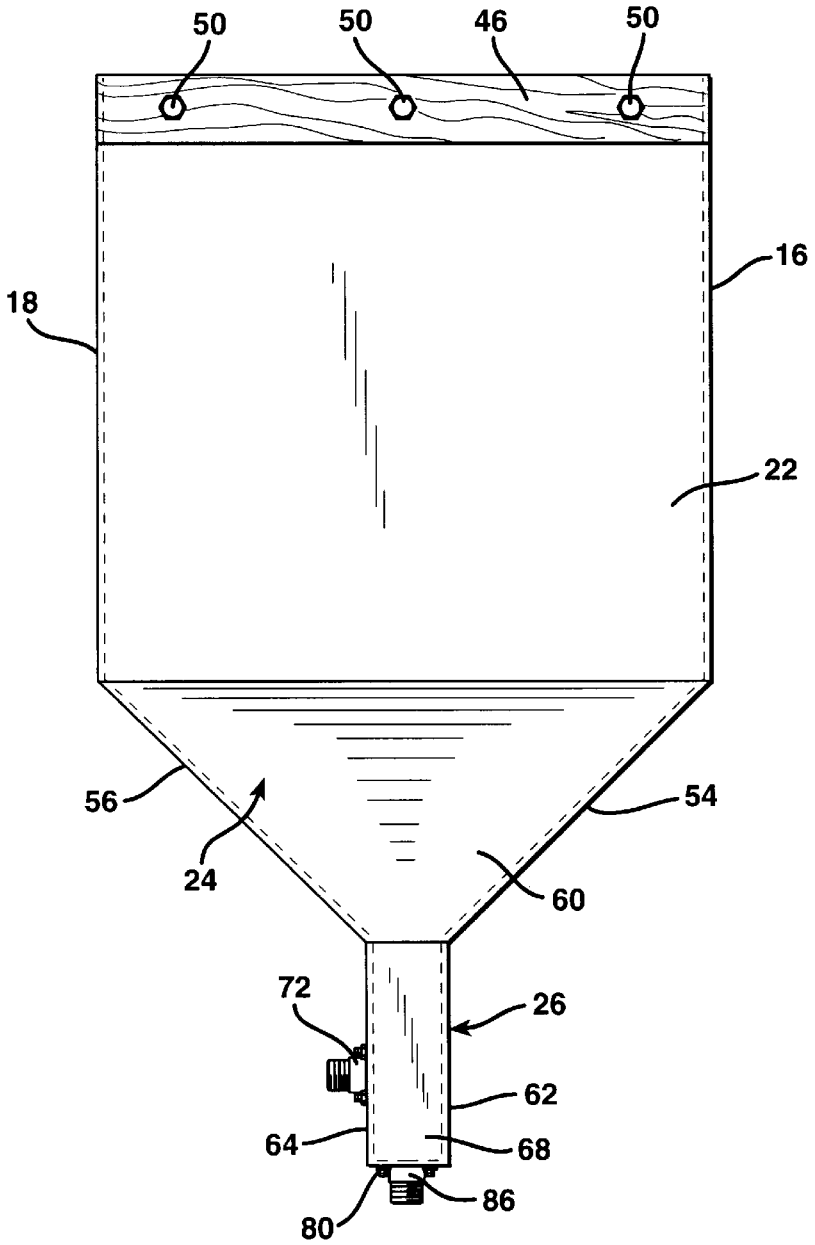
FIG. 4 is a side elevational view illustrating the kettle of the invention in isolation.

The structure of the kettle 12 is best depicted in FIGS. 2, 3, and 4. The side walls 16, 18, 20, and 22 of the kettle 12 are formed of sheets of No. 304 stainless steel, each having a square configuration and measuring thirty inches on each side. The side walls are arranged in opposing pairs in which the side walls 16 and 18 within one of the pairs of side wall are mutually parallel to each other, while the side walls 20 and 22 within the other pair of side walls are also mutually parallel to each other. The pairs of side walls 16,18 and 20,22 are oriented mutually perpendicular to each other, as illustrated in FIGS. 3 and 4. The top opening of the kettle 12 is thereby square in shape. The side walls 16, 18, 20, and 22 are joined together by vertical welds that connect the adjacent side walls to each other and form a liquid-tight seal therebetween.

The kettle 12 is equipped with a flat, square lid 14, which is merely a plate of No. 304 stainless steel that measures thirty-two inches on a side. The lid 24 is two inches larger in both directions than the top opening of the kettle 12 formed between the sides 16, 18, 20, and 22 thereof. The lid 14 thereby overhangs the top edges of the sides 16, 18, 20, and 22 by one inch around its entire perimeter when it is set atop the kettle 12. A pair of wooden handles 15 are bolted to the lid 14. The lid 14 is thereby freely removable for unencumbered loading of the kettle 12. The handles 15 are used to lift the lid 14 to allow chunks of solidified glycerine base, indicated at 23 in FIG. 2, to be dropped into the kettle 12. The lid 14 is also important because it restricts alcohol and water loss through evaporation from the melted glycerine soap base.

The bottom 24 of the kettle 12 is formed with the configuration of an inverted pyramid, truncated at the drain 26. Specifically, the bottom 24 is formed of four trapezoidal-shaped panels 54, 56, 58, and 60 of No. 304 stainless steel. Each of the trapezoidal panels 54, 56, 58, and 60 has a major base thirty inches in length and a minor base four inches in length. The panels 54, 56, 58, and 60 are oriented at an angle of forty-five degrees relative to vertical so as to together form a funnel at the bottom 24 of the kettle 12 toward the drain 26. The major bases of the panels 54, 56, 58, and 60 all lie in a common horizontal plane that is located thirteen inches above another horizontal plane in which all of the minor bases of the panels 54, 56, 58, and 60 reside. The panels 54, 56, 58, and 60 are welded to each other at their contacting interfaces.

The drain 26 is formed of four rectangular plates of No. 304 stainless steel 62, 64, 66, and 68. Each of the stainless steel plates 62, 64, 66, and 68 is four inches in width and eleven inches in height. The plates 62, 64, 66, and 68 are welded together by vertical welds where they meet to form perpendicular corners, and are also welded along their upper edges to the minor bases of the lower extremities of the base panels 54, 56, 58, and 60 where they meet in contact therewith.

The vertical duct 26 has a liquified soap withdrawal port 70 formed therein in the plate 64, centered four and a half inches above the lower extremity of the drain 26. A soap withdrawal pipe coupling 72 having a centrally located nipple thereon directed laterally outwardly from the soap withdrawal port 70 is fastened by bolts 73 to the drain plate 64. A horizontally oriented withdrawal line 74 is attached to the nipple of the coupling 72 in communication with the withdrawal port 70. The withdrawal line 74 may be provided with a collar connection that is screwed onto the nipple of the pipe coupling 72 at the withdrawal port 70. A gasket within the collar of the withdrawal line 74 prevents soap from leaking out between the pipe coupling 72 and the withdrawal line 74. The distal or outboard end of the withdrawal line 74 is provided with a ballcock valve 76 having a manually actuatable lever 78.

The bottom of the drain 26 is closed by a transverse, horizontally oriented, end plate 80 having a central, vertical debris clean out port 82 defined therein. The edges of the end plate 80 are welded to the lower edges of the vertically oriented plates 62, 64, 66, and 68. The debris clean out port 82 is normally closed by a cap 84 that is screwed onto the downwardly projecting nipple of a fitting 86 that is secured by bolts 88 to the end plate 80.

The portion of the vertical drain duct 26 located below the soap withdrawal port 70 serves as a debris well. The loaves of glycerine soap base that are melted in the kettle 12 are often colored white with a cake white colorant. This colorant tends to accumulate at the bottom of the kettle 12. Without the debris well the colorant will tend to discolor the melted glycerine soap base being withdrawn through the withdrawal line 74. However, by providing the debris well at the lower end of the drain 26 beneath the soap withdrawal port 70, the cake white colorant will sink to the bottom of the debris well. The cap 84 may be removed periodically, typically on a weekly basis, to clean out the debris well. The drain system of the kettle 12 thereby provides a trap at its lower extremity that tends to remove discoloring additives that would otherwise collect as a scum or powder at the bottom of the kettle 12 and which would otherwise be entrained in the liquified soap being drawn off through the withdrawal line 74.

The jacket 28 of the soap melting apparatus 10 is formed with four vertically oriented, rectangular, plywood sheets 100, 102, 104, and 106, each three-quarters of an inch thick. The plywood sheets 104 and 106 are thirty inches in width and forty inches in length. The sheets 104 and 106 are entrapped between the outside surfaces of the side walls 20 and 22 of the kettle 12 and the inwardly facing surfaces of the upright legs formed by the support posts 44 and are secured to the posts 44 by nails or screws. The other plywood sheets, 100 and 102, forming the jacket 28 are thirty-eight inches in width and forty inches in length. These plywood sheets are secured to outside surfaces of the upright legs formed by the supporting posts 44 by means of nails or screws. The vertical plywood sheets 100, 102, 104, and 106 not only provide a support for thermally insulating material, but also stabilize the upright posts 44.

The jacket 28 also includes a floor 30 which likewise is formed of three-quarter inch thick plywood. The floor 30 is horizontally oriented and has a square configuration, thirty inches on a side. The floor 30 extends between the pairs of opposing sides 100,102 and 104,106 of the jacket 28.

As illustrated in FIG. 2, the jacket 28 is also provided with a subfloor 112. The subfloor 112 is located beneath the floor 30 and is also formed of plywood three-quarters of an inch in thickness. The space between the subfloor 112 and the floor 30 provides a protected enclosure for the electrical wires 114 that connect the infrared heating lamps 34 to a conventional 110 or 120 volt power supply plug indicated at 116 in FIG. 7.

Figure 6:
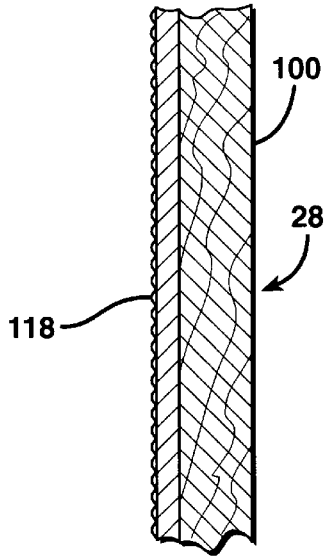
FIG. 6 is a sectional detail of the area indicated at 6 in FIG. 5 illustrating the structure of the thermally insulating jacket having a layer of thermal insulating material on the interior surface thereof.

To achieve thermal insulation, the interior surfaces of the sides 100, 102, 104, and 106 and the floor 30 of the jacket 28 are covered with sheets of high-efficiency aluminized bubble pack, indicated as layers 118 in FIG. 2. A cross-sectional detail of this structure is illustrated in FIG. 6. Specifically, a layer 118 of aluminized bubble insulation material is cemented to each of the interiorly facing surfaces of the plywood sheets 100, 102, 104, 106, and 30. The layers 118 provide the necessary thermal insulation to maintain appropriate temperatures within the dead air cavity 32 within the jacket 28 below the bottom 24 of the kettle 12, and above the jacket floor 30. The insulating layers 118 also maintain an appropriate temperature within the kettle 12 itself. Specifically, the contents of the kettle 12 are maintained within a temperature range of 130° F. to 140° F.

Figure 5:
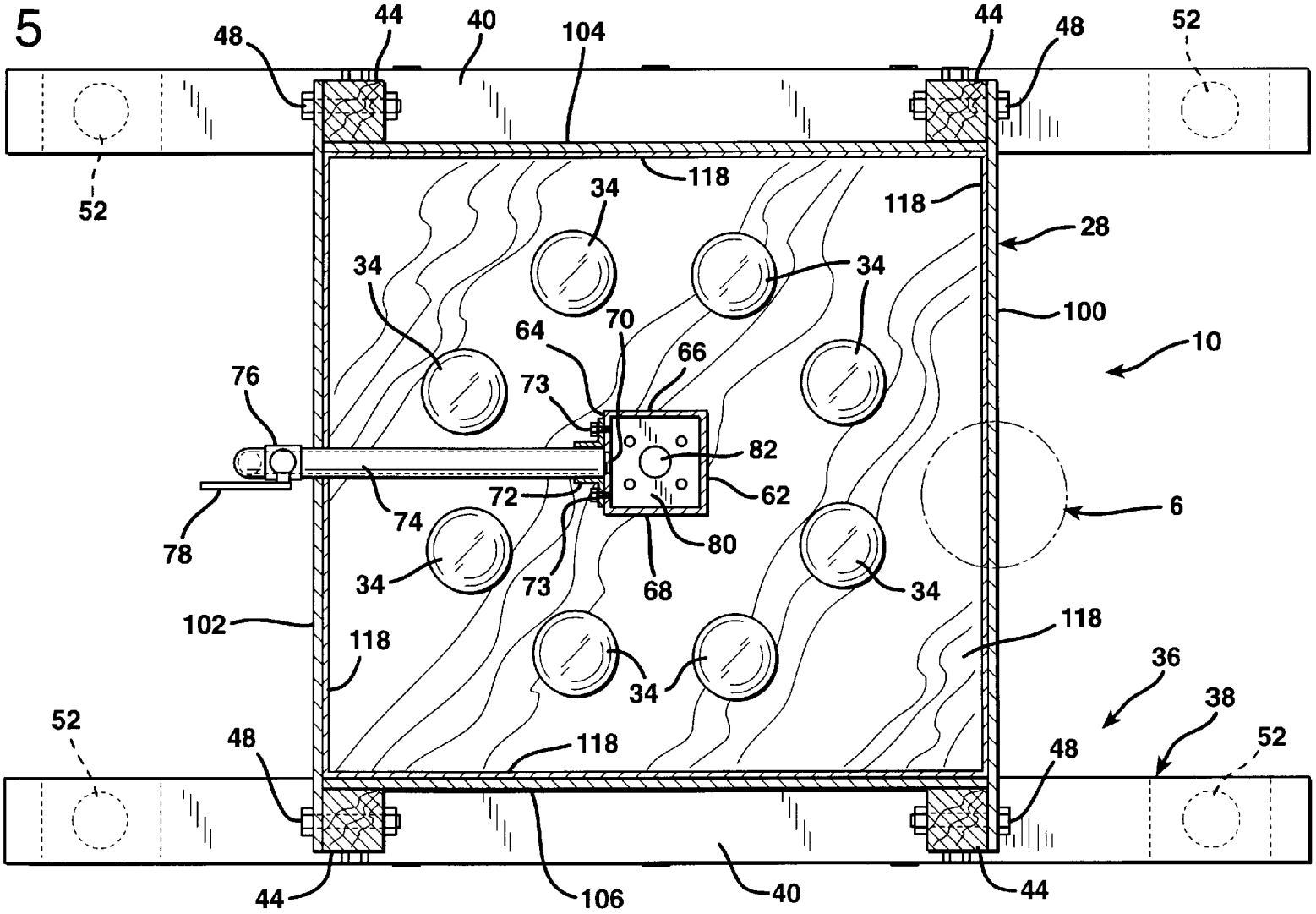
FIG. 5 is a sectional plan view taken along the lines 5—5 of FIG. 1.

As illustrated in FIGS. 3 and 5, the eight infrared lamps 34 are located uniformly at equal angular increments about the vertical, central axis of the drain 26 of the kettle 12 and at a distance of about eight inches therefrom. The bulbs of the infrared lamps 34 are all aligned on longitudinal, vertical axes 119 and are directed straight upwardly toward the downwardly and inwardly inclined panels 54, 56, 58, and 60 of the bottom 24 of the kettle 12.

Figure 7:
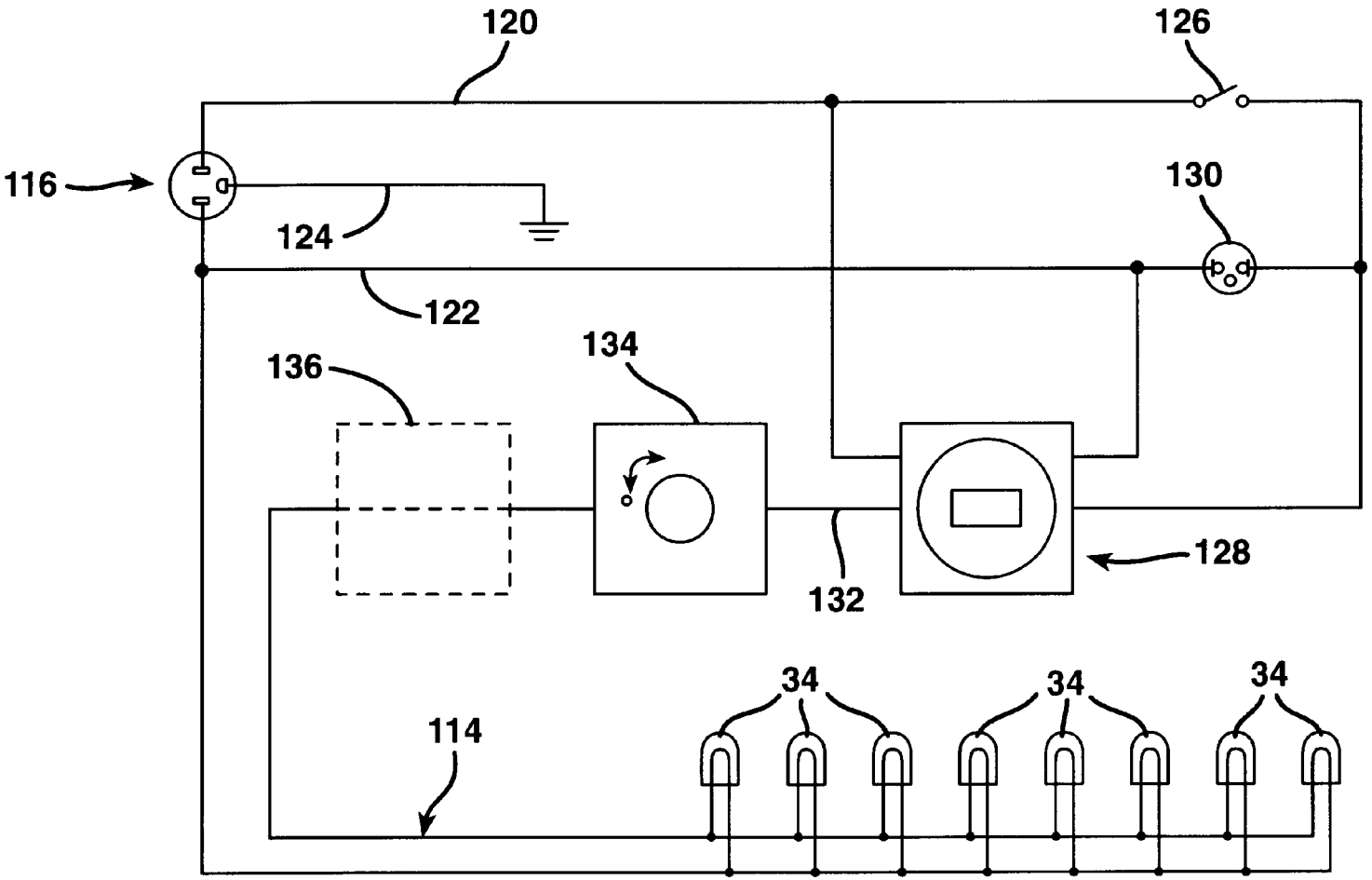
FIG. 7 is an electrical schematic diagram illustrating the control system for the apparatus of FIGS. 1–6.

FIG. 7 illustrates the preferred electrical control system for the apparatus 10. As illustrated, in that drawing figure, the infrared lamps 34 are operated at 110 or 120 volts alternating current by a plug 116 that plugs into a conventional wall outlet. The hot electrical line leading from the plug 116 is indicated at 120, while the neutral line is indicated at 122. The electrical ground line is indicated 124. A single pole, single throw switch 126 provides power to a seven-day, programmable timer 128. A neon lamp 130 indicates the status of the switch 126.

The programmable timer 128 has an output line 132 that is normally open and which is connected to a variable rheostat 134. The rheostat 134 is set to provide power to each of the lamps 34 at between 0 and 250 watts, depending upon the melted glycerine base flow rate desired through the withdrawal line 74. The variable rheostat 134 adjustably controls the electrical power that is supplied to the infrared lamps 34.

Also, an electrical thermostat 136 may be located in the kettle 12 and connected to the rheostat 134 to automatically maintain temperature within the kettle 12 to within a predetermined range. The optimum temperature range for melting glycerine soap base is between 130° F. and 140° F., so that is the range at which the thermostat 136 should be set.

In the practice of the method of the invention the kettle 12 is initially filled with about one thousand pounds of loaves 23 of glycerine soap base at night with the ballcock valve 76 initially closed. The electrical switch 126 is closed and the programmable timer 128 is set to produce the desired temperature of 130° F. to 140° F. in the kettle 12. The thermostat 136 is set to maintain this temperature. The circuitry of FIG. 7 then operates the infrared lamps 34 to melt the loaves 23 to produce between about one hundred thirty and one hundred fifty gallons of liquified glycerine soap base.

In the morning when the first work shift arrives, all of the glycerine in the kettle 12 is melted and ready for withdrawal through the withdrawal line 74. The ballcock valve 76 is then opened using the lever 78 and liquified glycerine soap base is withdrawn at the rate of one pound per minute. The withdrawn liquified soap base is mixed with essential oils or fragrance oils, colorants, or any other desired additives, such as ribbons or solid pieces of glycerine base. The mixture is then cast into cakes of glycerine soap.

As the liquified glycerine base is drawn off through the withdrawal line 74, forty-pound slabs of solidified glycerine base are split in two to form loaves 23 of about twenty pounds each. These loaves 23 are dropped into the kettle 12 to maintain the liquified level of melted glycerine soap nearly to the top of the kettle 12, as illustrated in FIG. 2. The solid loaves 23 of glycerine soap base are heavier than the melted glycerine, so that the loaves 23 tend to drop toward the bottom of the kettle 12 as illustrated. The vertical orientation of the bulbs of the infrared lamps 34 against the downwardly inclined panels 54, 56, 58, and 60 of the kettle 12 ensures the direction of the radiant energy from the lamps 34 at an angle against the bottom 24 that enhances the efficiency of heat transfer thereto.

The loaves 23 of glycerine soap base are formed of saponified oils of a variety of blends of salts of fat that absorb a considerable amount of heat. Nevertheless, the size and unobstructed configuration of the dead air cavity 32, the insulating effect of the aluminized bubble insulation layers 118, the configuration of the kettle 12 and the surrounding jacket 28, and the orientation of the infrared lamps 34 is such as to maintain the temperature of the contents of the kettle 12 within the optimum range of between 130° F. and 140° F.

The rheostat 134 is adjusted as necessary to prevent undue cycling of the system due to operation of the thermostat 136. To maintain a flow of liquified glycerine soap base from the withdrawal line 74 at the rate of one pound per minute while maintaining the contents of the kettle 12 at between one hundred thirty and one hundred fifty gallons, the system is operated to heat more than one hundred gallons of glycerine soap. Preferably at least on hundred thirty gallons of glycerine soap are heated in the kettle 12, but utilizing no greater than two thousand watts of power. Also, the bottom 24 of the kettle 12 is heated by means of the infrared lamps 34 using no greater than two watts of power per square inch of surface area of the bottom 24 of the kettle 12. In actuality, the heat applied to the bottom 24 by the lamps 34 is only about 1.1 watts per square inch. About twenty-four hundred pounds of glycerine soap base may be melted and drawn off through the withdrawal line 74 during each eight-hour shift according to the system of the invention.

As previously indicated, it is desirable to clean out the debris well formed by the lower portion of the drain duct 26 beneath the withdrawal port 70 about once a week. Also, it is desirable to clean the inside surface of the entire kettle 12 on a periodic basis. The present invention provides a system for melting glycerine soap that consumes far less electrical power than conventional steam jacketed systems. Also, the present invention avoids the corrosion problems that often develop in steam jacketed systems since no water is required in the operation of the system of the invention.

Undoubtedly, numerous variations and modifications of the invention will become readily apparent to those familiar with the production of glycerine soap. Accordingly, the scope of the invention should not be construed as limited to the specific embodiment depicted and the manner of implementation of the method described.

I claim:

1. An apparatus for melting glycerine soap comprising:

a kettle having a top opening, upright side walls, and a bottom with a drain at its center, a thermally insulated jacket disposed about said side walls and having a floor spaced beneath said bottom of said kettle to define a hollow, thermally insulated, air filled heating cavity therebeneath, at least one electrically operated heating element disposed in said thermally insulated cavity atop said floor of said jacket and beneath said bottom of said kettle to uniformly heat said bottom of said kettle, and a structural support attached to said kettle and located entirely externally relative to said thermally insulated heating cavity to hold said kettle above said floor of said jacket.

2. An apparatus according to claim 1 further comprising a plurality of electrically operated heating elements as aforesaid disposed in an array atop said floor of said jacket.

3. An apparatus according to claim 2 wherein said heating elements are infrared heat lamps.

4. An apparatus according to claim 1 wherein said kettle has a capacity greater than one hundred gallons.

5. An apparatus according to claim 4 wherein said kettle has a capacity of at least about 130 gallons and said at least one heating element is operated by no more than two thousand watts of power.

6. An apparatus according to claim 1 wherein said structural support is comprised of a plurality of vertical legs secured to said kettle externally of said jacket.

7. An apparatus according to claim 6 wherein said structural support includes a carriage located beneath and supporting said vertical legs.

8. Apparatus for melting glycerine soap comprising:

a kettle having a top opening, upright sides, a bottom, and a drain at the center of said bottom, a thermally insulating jacket disposed about said kettle so as to laterally surround said upright sides and having a floor spaced below said kettle bottom to define an air cavity beneath said kettle bottom and above said jacket floor, electrically operated heating means located in said air cavity for uniformly heating said bottom of said kettle, and supporting means located completely external to said air cavity for holding said bottom of said kettle above said floor of said jacket.

9. Apparatus according to claim 8 wherein said electrically operated heating means is comprising of an array of infrared lamps.

10. Apparatus according to claim 9 wherein said kettle is formed of stainless steel and has a capacity of greater than one hundred gallons and said infrared lamps draw a maximum power of no greater than two thousand watts.

11. Apparatus according to claim 10 further comprising a variable rheostat connected to said infrared lamps for adjustably controlling electrical power supplied thereto, and a thermostat in said kettle connected to said rheostat to automatically maintain temperature in said kettle within a predetermined range.

12. Apparatus according to claim 8 wherein said supporting means is comprised of a plurality of vertical posts located outside of said jacket and supporting said kettle externally of said sides thereof.

13. Apparatus according to claim 12 wherein said supporting means includes a mobile cart supporting said vertical posts from beneath.

14. Apparatus according to claim 8 wherein said sides of said kettle are formed of opposing pairs of vertical side walls in which said side walls within each pair are mutually parallel to each other and said pairs of side walls are mutually perpendicular to each other, whereby said top opening of said kettle is rectangular in shape, and said bottom of said kettle is formed with the configuration of an inverted pyramid, truncated at said drain.

15. Apparatus according to claim 14 wherein said drain is comprised of a vertical duct having a liquified soap withdrawal port therein for discharging soap in a liquified state from said kettle and a debris well extending at least about four and one-half inches below said withdrawal port.

16. Apparatus according to claim 14 further comprising sheets of plastic, aluminized bubble pack disposed on the interior surfaces of said jacket to provide thermal insulation therefor.

17. A method of melting glycerine soap in a kettle having a top opening, upright side walls, and a bottom with a drain at its center in which said kettle is surrounded with a thermally insulated jacket having a floor spaced below said bottom of said kettle to define a hollow, thermally insulated, air filled heating cavity beneath said bottom of said kettle comprising:

supporting said kettle externally relative to said heating cavity to hold said kettle above said floor of said jacket, uniformly heating said kettle bottom from within said air filled heating cavity with at least one electrically operated heating element, introducing blocks of solidified glycerine soap base into said top opening, whereby said at least one heating element melts said glycerine soap base blocks and maintains said soap base at a temperature of no greater than 140° F., and withdrawing said melted glycerine soap base through said drain for the addition of additives thereto.

18. A method according to claim 17 further comprising heating more than one hundred gallons of glycerine soap base in said kettle utilizing no greater than two thousand watts of power.

19. A method according to claim 18 further comprising heating at least about one hundred thirty gallons of glycerine soap base in said kettle.

20. A method according to claim 18 further comprising heating said bottom of said kettle with electrical power of no greater than two watts per square inch of surface area of said bottom of said kettle.

* * * * *